US007722288B2

(12) United States Patent
Prevost et al.

(10) Patent No.: US 7,722,288 B2
(45) Date of Patent: May 25, 2010

(54) METHOD OF INSTALLING A SYNTHETIC GRASS SYSTEM

(75) Inventors: Jean Prevost, Westmount (CA); Stephen Murphy, Ile Bizard (CA); Jean Beliveau, Montreal (CA)

(73) Assignee: Fieldturf Tarkett Inc., Montreal (CA)

( * ) Notice: Subject to any disclaimer, the term of this patent is extended or adjusted under 35 U.S.C. 154(b) by 12 days.

(21) Appl. No.: 11/977,435

(22) Filed: Oct. 24, 2007

(65) Prior Publication Data

US 2008/0219770 A1 Sep. 11, 2008

Related U.S. Application Data

(60) Provisional application No. 60/862,747, filed on Oct. 24, 2006.

(51) Int. Cl.
*E01C 13/08* (2006.01)
*E02B 11/00* (2006.01)

(52) U.S. Cl. ..... 405/45; 405/43; 405/38; 472/92

(58) Field of Classification Search ..... 405/36, 405/38, 43, 44, 45, 46, 50, 51; 472/92
See application file for complete search history.

(56) References Cited

U.S. PATENT DOCUMENTS 3,332,828 A 7/1967 Faria et al.
3,625,010 A 12/1971 Hakundy
3,740,303 A 6/1973 Alderson et al.
3,908,385 A * 9/1975 Daniel et al. ..... 405/37
3,995,079 A 11/1976 Haas
4,044,179 A 8/1977 Haas
4,389,435 A 6/1983 Haas
4,396,653 A 8/1983 Tomarin
4,405,665 A 9/1983 Beaussier et al.
4,421,439 A 12/1983 ter Burg et al.
4,472,086 A 9/1984 Leach
4,535,021 A 8/1985 Friedrich
4,735,825 A 4/1988 Friedrich (Continued)

FOREIGN PATENT DOCUMENTS

AU 656435 2/1995

(Continued)

OTHER PUBLICATIONS

PCT International Search Report for PCT/US07/22509, International Filing Date Oct. 24, 2007, 2 pages.

(Continued)

*Primary Examiner*—Frederick L Lagman
(74) *Attorney, Agent, or Firm*—Factor & Lake, Ltd.

(57) ABSTRACT

A drainage system for use with a synthetic grass surface, the system having a base having a center portion with a first depth and a perimeter channel with a second depth being greater than the first depth, a plurality of tiles above the base, and a synthetic grass above the plurality of tiles. Also, a business method facilitates installation of a synthetic grass system which utilizes drainage tiles positioned between a stone base and the bottom of the synthetic turf, wherein a mold for manufacturing the tile is provided from the turf company to a manufacturing company located in relatively close proximity to where the synthetic turf system is to be installed.

17 Claims, 2 Drawing Sheets

U.S. PATENT DOCUMENTS

| | | | | | |
|---|---|---|---|---|---|
| 4,735,828 | A | | 4/1988 | Cogswell et al. | |
| 4,815,892 | A | | 3/1989 | Martin | |
| 4,913,596 | A | * | 4/1990 | Lambert, III | 405/43 |
| 5,064,308 | A | * | 11/1991 | Almond et al. | 405/43 |
| 5,255,998 | A | | 10/1993 | Beretta | |
| 5,383,314 | A | | 1/1995 | Rothberg | |
| 5,460,867 | A | | 10/1995 | Magnuson et al. | |
| 5,489,317 | A | * | 2/1996 | Bergevin | 47/1.01 R |
| 5,601,886 | A | | 2/1997 | Ishikawa et al. | |
| 5,651,641 | A | | 7/1997 | Stephens et al. | |
| 5,944,444 | A | * | 8/1999 | Motz et al. | 405/37 |
| 5,958,527 | A | | 9/1999 | Prévost | |
| 5,958,538 | A | | 9/1999 | Kessler | |
| 5,958,540 | A | | 9/1999 | Berard et al. | |
| 5,976,645 | A | | 11/1999 | Daluise et al. | |
| 6,042,915 | A | | 3/2000 | Kessler | |
| 6,127,015 | A | | 10/2000 | Kessler | |
| 6,171,984 | B1 | | 1/2001 | Paulson et al. | |
| 6,221,445 | B1 | | 4/2001 | Jones | |
| 6,263,616 | B1 | * | 7/2001 | Hummer | 47/65.9 |
| 6,299,959 | B1 | | 10/2001 | Squires et al. | |
| 6,428,870 | B1 | | 8/2002 | Bohnhoff | |
| 6,527,889 | B1 | | 3/2003 | Paschal et al. | |
| 6,877,932 | B2 | | 4/2005 | Prévost | |
| 2003/0039511 | A1 | * | 2/2003 | Prevost | 405/36 |
| 2003/0092531 | A1 | * | 5/2003 | Daluise | 472/92 |
| 2004/0058096 | A1 | | 3/2004 | Prévost | |
| 2005/0223666 | A1 | | 10/2005 | Forster et al. | |
| 2008/0145574 | A1 | * | 6/2008 | Julicher et al. | 428/17 |
| 2008/0240860 | A1 | * | 10/2008 | Ianniello | 405/53 |

FOREIGN PATENT DOCUMENTS

| | | | | |
|---|---|---|---|---|
| CA | 2102460 | | | 5/1995 |
| CA | 2206839 | | | 7/1996 |
| CA | 2218314 | | | 9/1998 |
| CA | 2352934 | A1 | | 1/2003 |
| CA | 2393240 | A1 | | 1/2003 |
| CH | 670572 | | | 6/1989 |
| DE | 19521944 | | | 12/1995 |
| DE | 29604175 | U | | 6/1997 |
| EP | 0185645 | | | 6/1986 |
| EP | 455260 | | | 11/1991 |
| FR | 2277172 | | | 1/1976 |
| GB | 2352954 | | * | 2/2001 |
| JP | 59195907 | | | 11/1984 |
| JP | 60223506 | | | 11/1985 |
| JP | 63064738 | | | 3/1988 |
| JP | 7229039 | | | 8/1995 |
| JP | 8049209 | | | 2/1996 |
| JP | 9057883 | | | 3/1997 |
| JP | 9164617 | | | 6/1997 |
| NL | 1007042 | C | | 3/1998 |
| WO | WO 8901076 | A1 | * | 2/1989 |

OTHER PUBLICATIONS

PCT Written Opinion o the International Searching Authority for PCT/US07/22509, International Filing Date Oct. 24, 2007, 3 pages.

* cited by examiner

METHOD OF INSTALLING A SYNTHETIC GRASS SYSTEM

RELATED APPLICATIONS

The present application claims priority to U.S. Provisional Application No. 60/862,747 filed on Oct. 24, 2006, the entirety of which is incorporated herein.

FIELD OF THE INVENTION

The present invention relates to synthetic grass systems, and more particularly to bases and drainage systems for synthetic grass and business methods for providing a synthetic grass system.

BACKGROUND OF THE INVENTION

Beneath a synthetic grass field a base or drainage system is usually installed. Such drainage systems may comprise a base of stone and a plurality of tiles above the stones. While both the conventional tiles and conventional stone bases are effective for their intended purposes, there can be problems associated with the tiles and stone bases, as well as the method of installing a synthetic grass field thereon.

The conventional stone bases are relatively deep and require substantial time for excavating the soil, laying the stone and leveling. Often, problems can arise based upon the availability of the stone, as well as the tedious nature of layering and leveling the same, resulting in delays. Also, because of the depth of the stone base, the cost of a synthetic grass system can be substantial. It is desirable to have a stone base that can minimize time delays and cost.

The conventional method of installing the stone underneath the synthetic grass and/or grass with tile requires several independent people to complete the project. First, a base installer is required to prepare the base which includes, among other things, layering and leveling of stone. Second, a grass installer must wait until the base installer is finished until the grass installer can begin to install the synthetic grass field. Additionally, there are time delays associated with shipping and receiving tile when underlying tile is to be used. It is desirable to have a method for installing that minimizes the time that the base installer is working, giving the grass installer more time and control over the installation.

Finally, synthetic grass companies typically have to ship multiple shipments of different materials to the job site, including, for example, drainage tiles. Multiple shipments cost money, can create delays, and potentially get lost. Additionally, storing such tiles takes up space. It is desirable to have a method of doing business that minimizes the amount of stored materials, shipped materials and potential delays.

SUMMARY OF THE INVENTION

Aspects of the present invention are intended to over come some of the problems associated with the conventions drainage systems, methods of installing synthetic grass systems, and business methods for providing a synthetic grass system.

In one aspect of the invention, the invention relates to a base that does not require the deep stone base of the conventional system. Conventional synthetic grass surfaces have a drainage base of crushed stone over a compacted soil base. Typically the drainage base is 68 inches deep and has generally three layers of stone: large stones on the bottom, medium sized stones in the middle and smaller stones on top. These conventional drainage bases require a substantial amount of stone, excavation depth and time and money. The drainage system of the present invention solves some of the problems associated therewith.

In another aspect of the invention, the invention relates to the method of installing a base wherein tiles positioned above the stone base are utilized to level the stone base. Such a method provides benefits such as reduced delays and potentially lowering cost.

In a further aspect of the invention, the invention relates to a business method. The business method includes the synthetic grass company providing a local manufacturing company, meaning in relative close proximity to the site where the field is to be installed, with a mold or molds for manufacturing the required tiles. The local manufacturing company can then make and, at least, partially assembly the tiles at the manufacturing site. This method is advantageous for a number of reasons, including minimizing the amount of tiles needed to be stored, minimizing the shipping, reducing cost and more importantly, facilitating a production and shipping that minimizes time delays.

Other benefits of the present invention will be readily apparent to one of ordinary skill in the art after reading the description of the invention and drawings herewith.

DETAILED DESCRIPTION OF THE PREFERRED EMBODIMENTS

Figure 1:
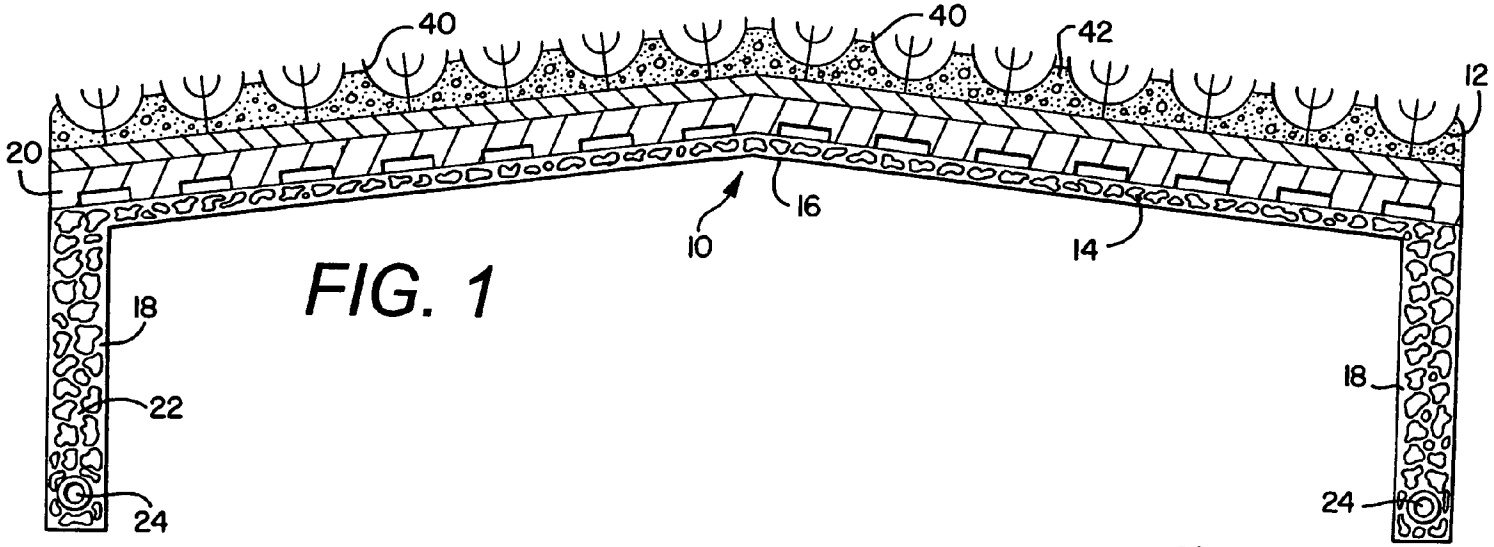
FIG. 1 is a perspective side cut away view of an embodiment of a base according to the present invention.
Figure 2:
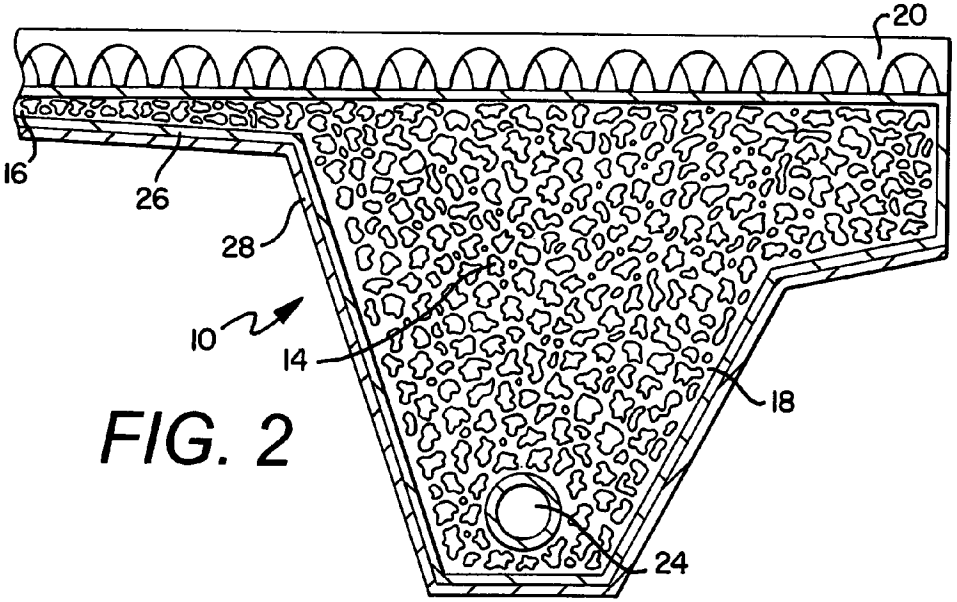
FIG. 2 is a second perspective side cut away view of another embodiment of a base according to the present invention.

While this invention is susceptible of embodiment in many different forms, there is shown in the drawings and will be described in detail below, specific embodiments with the understanding that the present disclosure is to be considered as an exemplification of the principles of the invention and is not intended to limit the invention to the embodiments illustrated.

It should be understood that like or analogous elements and/or components, referred to herein, are identified throughout the drawings by like reference characters. In addition, it should be understood that the drawings are merely a representation, and some of the components may have been distorted from actual scale for purposes of pictorial clarity.

According to one aspect of the invention, the invention provides a drainage system 10 for use with a synthetic grass surface 12, the system 10 includes a base 14 having a center portion 16 with a first depth and a perimeter 18 with a second depth being greater than the first depth, a plurality of tiles 20 above the drainage base, and, the synthetic grass 12 above the plurality of tiles 20.

In contrast to the conventional base, a base 14 according to the present invention is relatively smaller and it is preferred that it is approximately 2-3 inches deep in the center portion 16. The base 14 does not need the layering stone of the conventional base, and can use locally available stone and it is preferred that relatively larger stone is used to minimize over compaction by the small stones which leads to poor drainage characteristics. Utilizing locally available stone can decrease the cost of a synthetic grass system, as well as the time required for installing same.

The perimeter 18 of the drainage base may include a channel 22 with a depth deeper than the depth of the center portion 16. It is preferred that within the channel 22 a drain pipe 24 is provided and it is further preferred that the drain pipe 24 is perforated. In a preferred embodiment the drain pipe 24 is at least 18 inches below the synthetic grass system 12.

It is also contemplated that the base 12 has a slope downward from the center portion 16 to the perimeter 18. It is preferred that the slope is 0.5%; however, other sloping degrees may be used, if at all.

Additionally, the base 14 may be surrounded by a geotextile liner 26 and/or a water impermeable membrane 28.

Figure 3:
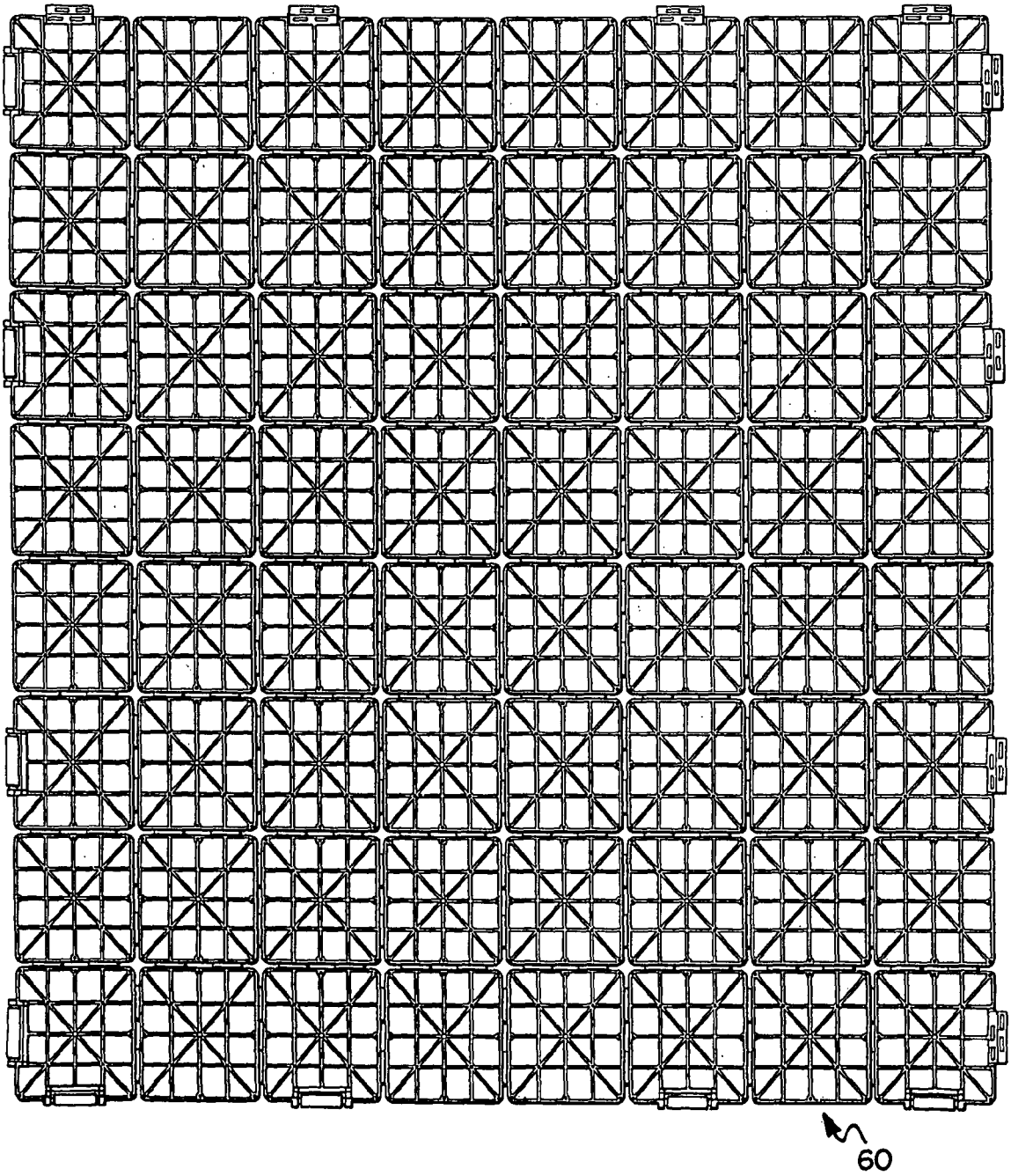
FIG. 3 is a top view of a tile used in a synthetic grass system.

A plurality of tiles 20 are provided above the base 14; and, it is preferred to use the tile 60 depicted in FIG. 3. A synthetic grass 12 is provided above a plurality of tiles 20. The synthetic grass system 12 can comprise of a backing with a plurality of upstanding ribbons 40 and an infill 42 disposed interstitially between the ribbons 40. One of ordinary skill in the art would appreciate that a variety of synthetic grass systems exists and can be utilized with all aspects of the present invention.

According to another aspect of the present invention, the invention provides a novel business method for providing a synthetic grass system. According to this aspect of the invention, the business method for providing a synthetic grass system at a site includes the steps of forming a mold for a base tile, engaging the services of a local manufacturing company being in close proximity to the site, forming a plurality of the base tiles at the local manufacturing company, transporting a plurality of strips of base tiles, and installing the base tiles at the site.

Typically, the synthetic grass company or the installer transports their own tiles. However, engaging a local manufacturing plant which is near the site where the synthetic grass system is intended to be installed, saves money and time. What is meant by the term "local manufacturing plant," is that the manufacturing plant is relatively close in proximity to the site where the synthetic grass system is to be installed. Of course, close in proximity will depend on the site. In some instances, most likely in densely populated areas and cites, the manufacturing plant may be less than a few miles from the site. In other instances, the manufacturing plant may be hundreds of miles away; however, it should still be, but is not required to be, located closer to the ultimate turf installation site than the synthetic grass company. Since the manufacturing plant is close to the site (or at least closer than the synthetic grass company), money is saved on transportation, as well as time associated with shipping.

The business method of the present invention may also include the step of loaning the mold to the local manufacturing plant. This would allow the synthetic grass company to retain a few number of molds, as opposed to producing new molds every time a new field is to be installed.

Additionally, the business method may further include the steps of assembling the tiles into strips. This also allows the manufacturing company to assemble the tiles into strips at the manufacturing plants, and it is preferred they are put into strips that will fit within a single conventional semi-truck container (7 ft by 40 ft). This assembly will save time at the site, because the installer will not need to spend time assembling the tiles into larger sections, or strips. Additionally, the synthetic grass installers do not need to have excess tiles taking up substantial space in storage spaces or warehouses. When the strips arrive at the site, they can be pulled off the container and pulled directly onto the stone base.

An additional aspect of the present invention is the utilization of the tiles to level the stone base. In this aspect of the invention, the invention includes the steps of excavating an area, installing a first base, installing a second base, utilizing the second base to level the first base, and providing a synthetic grass system disposed above the second base.

The area to be excavated is the area in which the synthetic grass assembly is intended to be installed.

The first base includes a plurality of stones, and it is contemplated that the first base be the base described herein. The second base includes a plurality of tiles. For example, the tile 60 depicted in FIG. 3 may be used. The second base may be installed tile by tile, or it may be installed in strips, described above.

After the second base is installed over the first base, the second base (i.e., the tiles) is used to level the stone base. By, for example, walking over the second base, the first base is leveled out. Such a method can save substantial money for both the synthetic grass installer and the customer. Additionally, such a method saves time for installing and reduces the chances for delays associated with both the installation of the tiles and the stone base. Moreover, if the stone base is substantially shorter than conventional bases, excavation time, time associated with shipping and laying stone are saved as well.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims.

What is claimed is:

1. A method of installing a synthetic grass system, the method comprising the steps of:

excavating an area;

installing a first base comprised of a plurality of stones;

installing a second base comprised of a plurality of tiles;

utilizing the second base to level the first base;

providing a synthetic grass system disposed above the second base.

2. The method of claim 1 further comprising the step of:

installing a geo-textile fabric to substantially surround the first base.

3. The method of claim 1 further comprising the first base having a center portion having a first depth and a perimeter channel with a second depth being greater than the first depth.

4. The method of claim 1 further comprising the first depth being approximately 2 inches.

5. The method of claim 1, wherein the tiles from the plurality of tiles are installed individually.

6. The method of claim 1, wherein the tiles from the plurality of tiles are installed in a plurality of strips.

7. A method for installing a drainage system for use with a synthetic grass surface, the method comprising the steps of:

installing a base having a center portion with a first depth and a perimeter channel with a second depth being greater than the first depth;

installing a plurality of tiles above the base, and, leveling the base by using the plurality of tiles.

8. The method of claim 7 further comprising the step of:

disposing a drainage pipe within the perimeter channel.

9. The method of claim 8 wherein the drainage pipe is porous.

10. The method of claim 7 further comprising the step of:

sloping the base downward from the center portion to the perimeter channel at approximately 0.5%.

11. The method of claim 7 wherein the base is approximately 2 inches deep at the center portion.

12. The method of claim 7 wherein the base is a drainage base of crushed stone.

13. The method of claim 12 wherein the stone is locally available, larger stone.

14. The method of claim 7 further comprising the step of:

surrounding the base with a geotextile liner.

15. The method of claim 7 further comprising the step of:

disposing a waterproof membrane below the base.

16. The method of claim 7, wherein the tiles from the plurality of tiles are installed individually.

17. The method of claim 7, wherein the tiles from the plurality of tiles are installed in a plurality of strips.

* * * * *